US006022184A

United States Patent [19]

Friedland

[11] Patent Number: 6,022,184

[45] Date of Patent: Feb. 8, 2000

[54] CLAMP-ON FORK LIFT ATTACHMENTS

[75] Inventor: Kenneth R. Friedland, Englewood, Colo.

[73] Assignee: Construction Technology, Inc., Denver, Colo.

[21] Appl. No.: 09/069,493

[22] Filed: Apr. 29, 1998

[51] Int. Cl.[7] ..... E02F 9/00

[52] U.S. Cl. ..... 414/724; 37/405; 37/903; 414/912

[58] Field of Search ..... 414/724, 912; 37/403, 405, 903; 24/457, 516, 525, 569; D08/73

[56] References Cited

U.S. PATENT DOCUMENTS

| | | | |
|---|---|---|---|
| 2,682,694 | 7/1954 | Kempkes | 24/569 |
| 3,908,844 | 9/1975 | Duffield | 414/724 |
| 3,914,830 | 10/1975 | Bolton | 269/189 X |
| 3,934,316 | 1/1976 | Driscoll | 24/569 X |
| 4,274,798 | 6/1981 | Guest . | |
| 4,910,891 | 3/1990 | Martin et al. . | |

OTHER PUBLICATIONS

Brochure, Mighty Scoop Forks, Coleman Methods Corp.
Brochure, Gearmore Forks, Gearmore, Inc.
Brochure, Bolt on Bucket Forks, Raine Manufacturing, Inc., Baerts Metal Products, Inc.
Brochure, From Bucket Loader to Versatile Fork Lift in less the 5 minutes, C.C. Bucket Forks, Inc.
Brochure, Our Forks Take 3,000 Pound Bites!, Full Vision, Inc.
Brochure, Fork Adaptors Patented, Greencastle Metal Works, Inc.
Brochure, Fork Lift Attachments, Guest Industries, Inc.
Advertisement, Bucket–Mounted Snoplows, Guest Industries, Inc.
Brochure, Attachments International.

*Primary Examiner*—Donald W. Underwood
*Attorney, Agent, or Firm*—John R. Ley

[57] ABSTRACT

A fork lift attachment includes upper and lower mounting segments for securing the fork lift attachment to a blade of a loader bucket. The upper mounting segment includes a top pad which is attached via a swivel attachment to a vertically movable rod for moving the top pad into flush contact with the top surface of the bucket blade. The lower mounting segment includes a bottom pad attached to a hinge mount for making flush contact with and supporting the bottom surface of the bucket blade. The swivel/hinge capability of the top and bottom pads provide for a secure clamping action which utilizes the entire surface area of the pads.

22 Claims, 5 Drawing Sheets

CLAMP-ON FORK LIFT ATTACHMENTS

FIELD OF THE INVENTION

This invention relates generally to a fork lift attachment which may be used to convert a loader to a fork lift. More particularly, the present invention relates to a new and improved mechanism for securely mounting detachable forks to a bucket of the loader without damaging the bucket.

BACKGROUND OF THE INVENTION

Clamp-on fork lift attachments are well known in the manufacturing industry. Such fork attachments are typically mounted to the bucket of a loader, such as a front end loader or a loader backhoe, to temporarily covert the loader for use as a fork lift. Such conversions are essential on job sites where dedicated fork lifts are not available or where available fork lifts do not have sufficient size or lifting capacity to lift the relatively large or heavy loads.

For example, fork lift attachments are commonly used on construction sites for unloading trucks and lifting heavy pallets of construction materials. Fork attachments are also commonly used by farmers to convert loaders for lifting bulky or heavy items such as hay bales.

The majority of non-permanent, clamp-on fork lift attachments typically include means for mounting a rear end of each fork to a substantially flat, bottom portion or "blade" of the loader bucket which extends immediately behind a cutting edge of the bucket. These mounting means commonly include a lower bearing surface for contacting a bottom surface of the bucket blade as well as a screw-type clamping means for contacting an upper surface of the bucket blade and securing the blade against the lower bearing surface. See for example the fork attachments shown in U.S. Pat. No. 4,274,798 issued to Guest in 1981.

While the specifics of the mounting means vary with different fork attachments, all known fork attachments which use the screw-type clamps suffer from a common problem relating to damaging the loader bucket. Specifically, all known screw-type clamps tend to form a rigid connection with the blade of the loader bucket such that the clamping mechanism itself may cause significant damage to the loader bucket.

For example, the known screw-type clamps utilize a threaded rod and an opposing bar to clamp the relatively thin portion of the bucket blade to the rear of the blade cutting edge. The clamped portion of the bucket blade is thus subjected to extremely high forces at the contact points of the threaded rod and the opposing bar, and these forces may be sufficient to warp the blade or lower portion of the loader bucket. Indeed, it is not uncommon for the threaded rod to punch a hole within the relatively thin metal of the bucket blade when the screw clamp is tightened.

Prior art FIG. 8 illustrates an example of previous attempts to improve upon the design of a typical screw-type mounting clamp. A steel pad 20 is welded to a free end 22 of the threaded rod 24. However, the threaded rod 24 is constrained to only move only in the axial direction and therefore the weld connecting the pad 20 to the threaded rod 24 constrains a contact surface 26 of the pad 20 to a purely horizontal plane as shown in FIG. 8. Similarly, the bottom bearing bar 30 is typically welded to the end of the fork attachment so that its contact surface 32 is also constrained to a horizontal plane as shown in FIG. 8.

It was commonly believed that the inclusion of the pad 20 at the end 22 of the threaded rod 24 would improve the contact between the pad 20 and the blade 36 of the loader bucket by increasing the surface area which contacts the relatively thin metal of the bucket blade. However, the prior art device shown in FIG. 8 assumes that the blade or lower portion of the loader bucket will be perfectly flat when it is inserted between the upper pad 20 and the lower bearing bar 30. Unfortunately, this is typically not the case as the blade portion of the bucket will frequently be slightly angled with respect to the fork due to the varying thickness of the bucket blade. Furthermore, even if the blade or lower portion of the bucket were to be considered perfectly flat, it is not uncommon for the blade 36 to be inserted between the upper pad 20 and the lower bearing bar 30 at an angle as shown in FIG. 8.

Thus, when the prior art pad 20 is tightened down onto the upper surface 38 of the bucket blade 36, only one edge 40 of the pad 20 contacts the upper surface 38 as opposed to the entire contact surface 26 as was intended. Similarly, the angle of the blade 36 also ensures that only an edge 44 of the lower bearing bar 30 (as opposed to the entire contact surface 32) will contact a lower surface 46 of the blade 36. Therefore, the purportedly improved mounting system shown in prior art FIG. 8 exemplifies the same problems as the more conventional screw-type clamps described above, including damage to the loader bucket due to the high forces applied to the bucket blade by the limited contact surfaces (i.e., the edges 40 and 44) of the upper pad 20 and the lower bearing bar 30.

Due to the damage which is caused by prior art fork lift attachments, it is not uncommon for equipment rental companies to refuse to rent such fork lift attachments and to refuse to allow customers to use their own fork attachments on rented or leased loaders. Therefore, an improved fork lift attachment having a mounting system which will not damage the loader bucket under even the heaviest loads is needed.

It is with respect to these and other background considerations, limitations and problems, that the present invention has evolved.

SUMMARY OF THE INVENTION

One of the significant aspects of the present invention pertains to an improved fork lift attachment having upper and lower mounting segments for mounting the fork lift attachment to a blade of a loader bucket, thereby allowing the loader to be used as a fork lift, without damaging the blade of the loader bucket.

Another significant aspect of the present invention relates to utilizing top swivel and bottom hinged pads for clamping the fork lift attachments to the bucket blade. The ability of the pads to swivel/hinge ensures that the contact surfaces of the respective pads are set flush against the bucket blade to minimize the concentrated force applied to the bucket blade and thereby prevent damage to the bucket during use of the fork lift attachments.

A further aspect of the present invention pertains to an improved mounting attachment for temporarily mounting auxiliary apparatus (such as fork lift attachments, snow removal blades, etc.) to the blade of a loader bucket.

In a preferred embodiment, the improved fork lift attachment includes a steel bar which defines a forward-facing tine and a rear mounting attachment for attaching the fork lift attachment to the blade of a loader bucket. An upper segment of the mounting attachment includes a cantilever support which engages a threaded rod to allow vertical movement of the rod. A lower end of the threaded rod is fixed to a top pad by a swivel attachment to allow a lower contact surface of the top pad to swivel as required to make flush contact with the top surface of the bucket blade. The swivel attachment includes in one embodiment a non-threaded extension extending below the threaded rod. The non-threaded extension has a diameter which is smaller than the diameter of the threaded rod to allow the extension to extend through a hole formed in the top pad. The swivel attachment also preferably includes a stop member fixedly attached to the end of the non-threaded extension to secure the top pad between the threaded rod and the stop member while allowing the top pad to swivel about the non-threaded extension. A counterbore is preferably formed in the lower contact surface of the top pad to accommodate the stop member and thereby prevent interference with the flush contact between the contact surface of the top pad and the top surface of the bucket blade.

The preferred embodiment of the fork lift attachment also includes a lower segment of the mounting attachment. The lower mounting segment preferably includes a bottom pad mounted on a hinged support for maintaining flush contact between an upper contact surface of the bottom pad and the bottom surface of the bucket blade. In the preferred embodiment, the hinged support comprises a rod rotatably supported by opposing bearings which are attached to the side of the steel bar, and the bottom pad is attached to the top of the rotating rod.

A more complete appreciation of the present invention and its scope may be obtained from the accompanying drawings, which are briefly summarized below, from the following detailed description of a presently preferred embodiment of the invention, and from the appended claims.

DETAILED DESCRIPTION OF THE DRAWINGS

DETAILED DESCRIPTION OF THE PREFERRED EMBODIMENT

Figure 1:
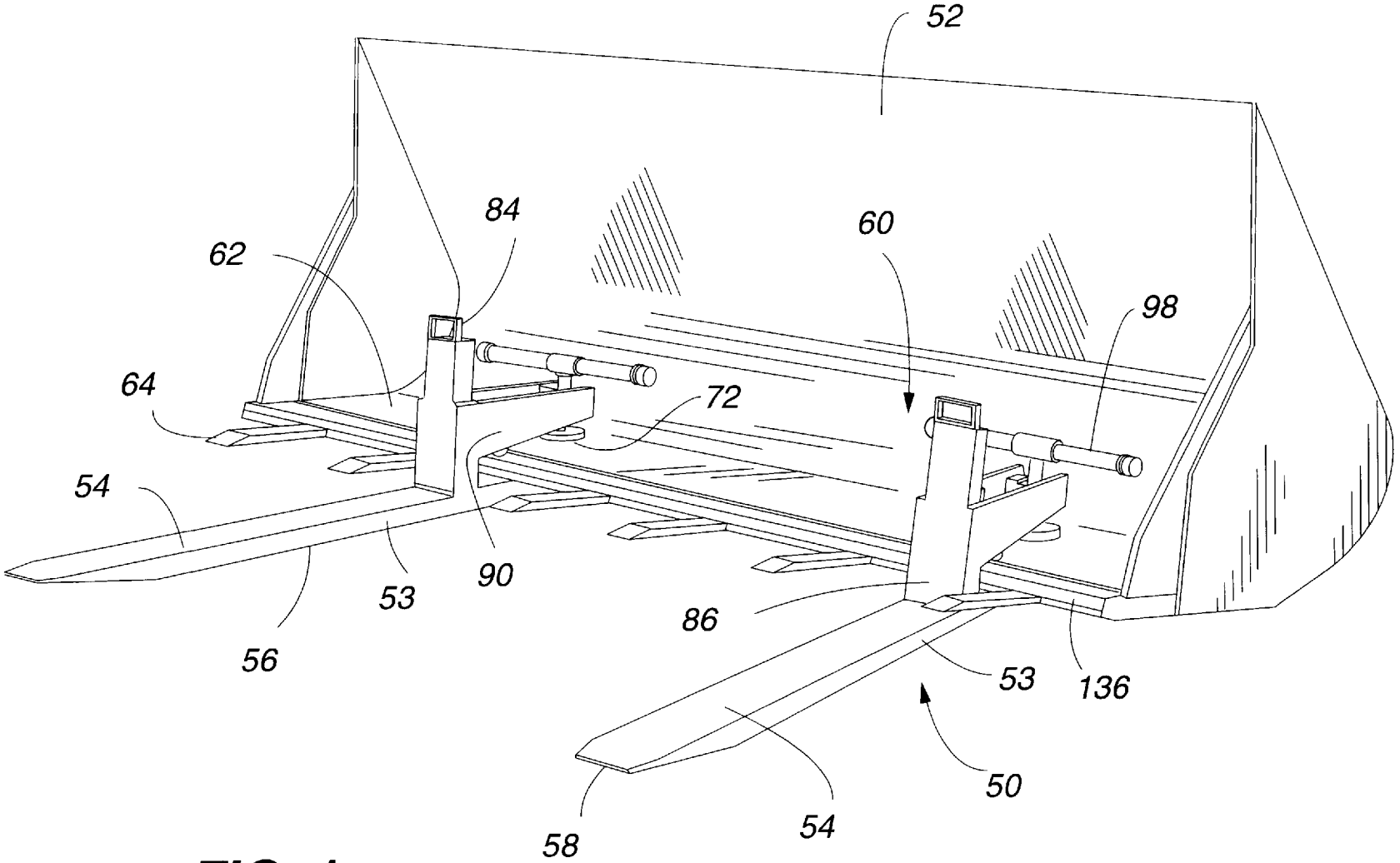
FIG. 1 is an isometric view of two fork lift attachments embodying the present invention secured to a blade of a loader bucket.

FIG. 1 illustrates two fork lift attachments 50 of the present invention attached to a bucket 52 of a conventional loader such as a front end loader or a loader backhoe (not shown). The fork lift attachments 50 (hereafter referred to as "forks" 50) are comprised in large part by a solid steel bar 53 having a flat upper surface 54. Each fork 50 includes a tine 56 (the forward portion of the steel bar 53) which employs the flat upper surface 54 and a shaped tip 58 for lifting objects such as pallets. The forks 50 also each include a rear mounting attachment 60 for mounting the fork 50 to a bottom wall portion or blade 62 of the bucket 52. The forks 50 have a sufficiently narrow width to allow for attachment of the forks between adjacent teeth 64 which may optionally be attached to the blade 62 of the bucket 52.

Figures 2, 3:
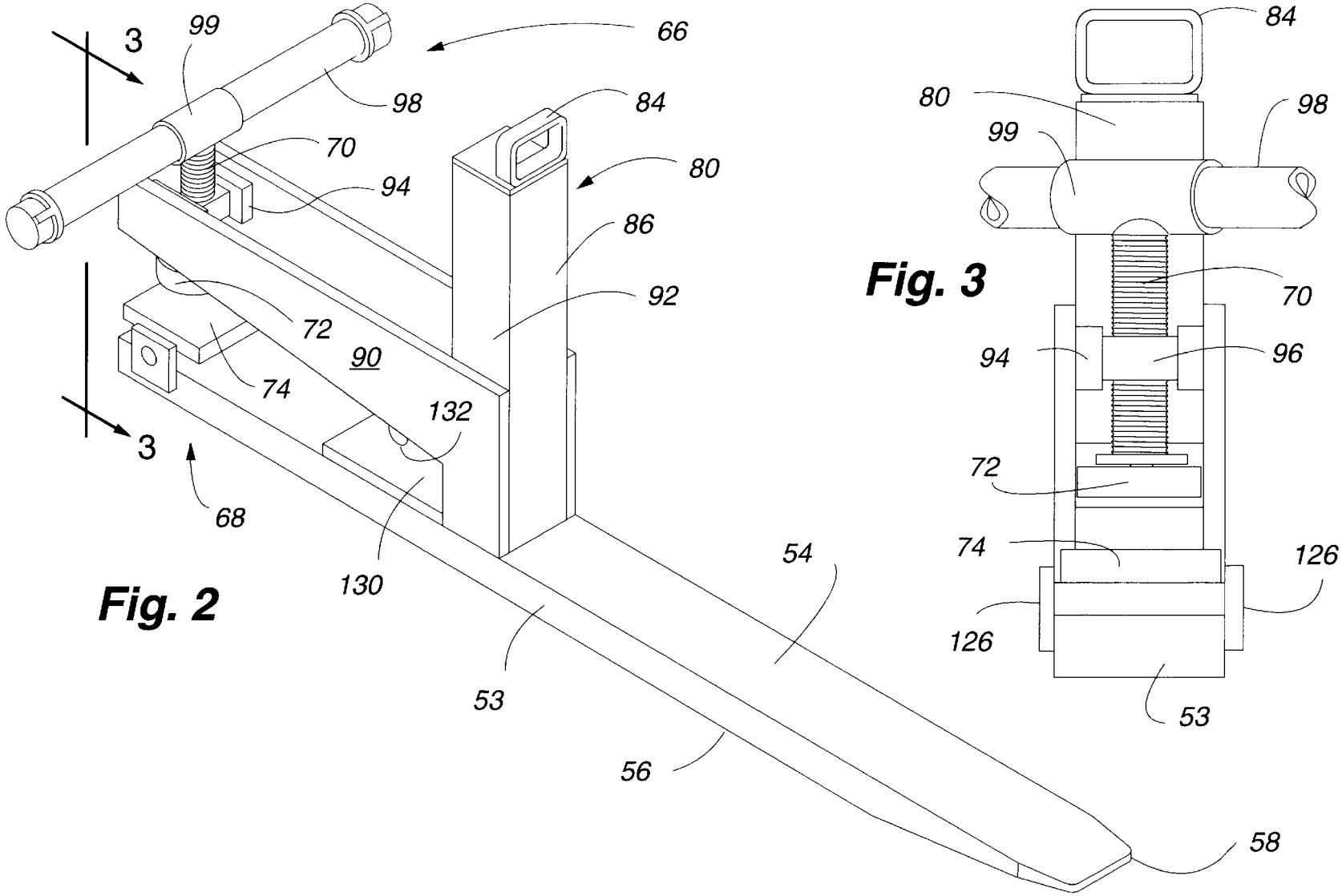
FIG. 2 is an enlarged isometric view of one of the fork lift attachments shown in FIG. 1.
FIG. 3 is an end view of the fork lift attachment taken substantially in the direction indicated by line 3—3 of FIG. 2.

A single fork 50 is shown in an enlarged isometric view in FIG. 2. FIG. 2 illustrates that the mounting attachment for the fork 50 essentially comprises an upper mounting segment 66 and a lower mounting segment 68. The upper mounting segment 66 preferably includes a threaded rod 70 connected to an upper mounting pad 72, while the lower mounting segment 68 preferably includes a lower mounting pad 74. FIG. 1 illustrates how the blade 62 is inserted between the upper and lower mounting segments 66 and 68, respectively. Once the blade 62 has been inserted within the mounting attachment 60 so that a bottom surface 76 (FIG. 7) of the blade 62 is supported on the lower mounting pad 74, the upper mounting pad 72 is lowered by rotating the threaded rod 70 until the pad 72 contacts a top surface 78 of the blade 62. The threaded rod 70 is then tightened to rigidly secure the blade between the pads 72 and 74. The upper and lower mounting segments 66 and 68 are described in greater detail below.

A vertical tube 80 (FIG. 2) is preferably welded to the flat surface 54 of the steel bar 53 at the rear of the tine 56. The tube 80 is preferably hollow and includes a top plate 82 to which a handle 84 is welded. The handle 84 allows the fork 50 to be maneuvered during the process of mounting the fork 50 to the blade 62 of the bucket 52. A forward face 86 of the tube 80 also acts as an upright for contacting and supporting loads which are placed on the tines 56.

Figures 4, 5:
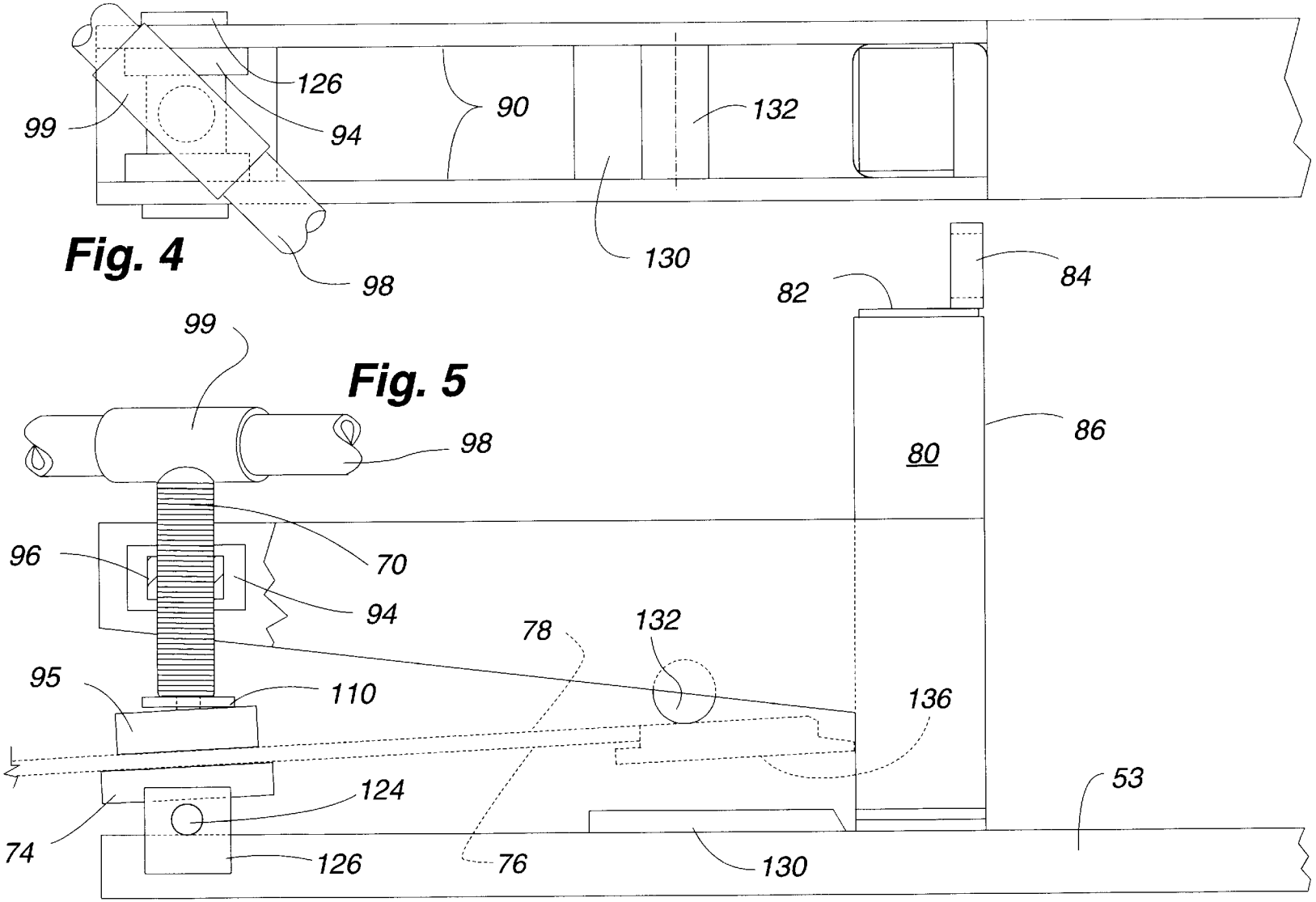
FIG. 4 is a partial top view of the fork lift attachment shown in FIG. 2.
FIG. 5 is a partial side view of the fork lift attachment shown in FIG. 2 with portions broken away for clarity, and with a portion of a bucket blade shown in phantom clamped between top and bottom pads of the fork lift attachment.

As described above, the upper mounting segment 66 includes the threaded rod 70 and the upper mounting pad 72. The rod 70 and pad 72 are suspended above the lower mounting segment 68 in a cantilever fashion by two opposing side plates 90 which are fixed to side faces 92 of the vertical tube 80 as shown in FIGS. 2 and 3. At the rear ends of the side plates 90 opposite the tube 80, nut spacers 94 are preferably welded to the interior opposing faces of the plates, as shown in FIGS. 2–4. A square nut 96 is then preferably welded between the nut spacers 94. The nut 96 is threaded to match the threads of the threaded rod 70 so that the threaded rod 70 may be raised or lowered through the nut 96. A handle 98 is slidably inserted within a fixed sleeve 99 at an upper end of the threaded rod 70 to provide leverage for turning the rod. The handle 98 can slide within the sleeve 99 to allow tightening of the rod 70 even when the handle 98 is positioned close to the side walls of the bucket 52.

Figure 6:
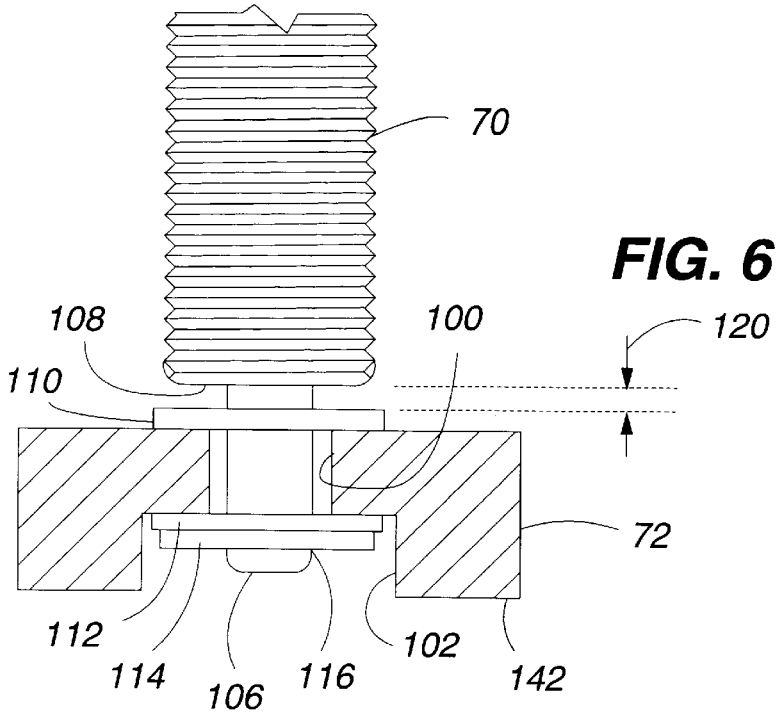
FIG. 6 is an enlarged view of the top pad shown in FIG. 5, with portions broken away to illustrate the details of the attachment of the top pad to the threaded rod.
Figure 7:
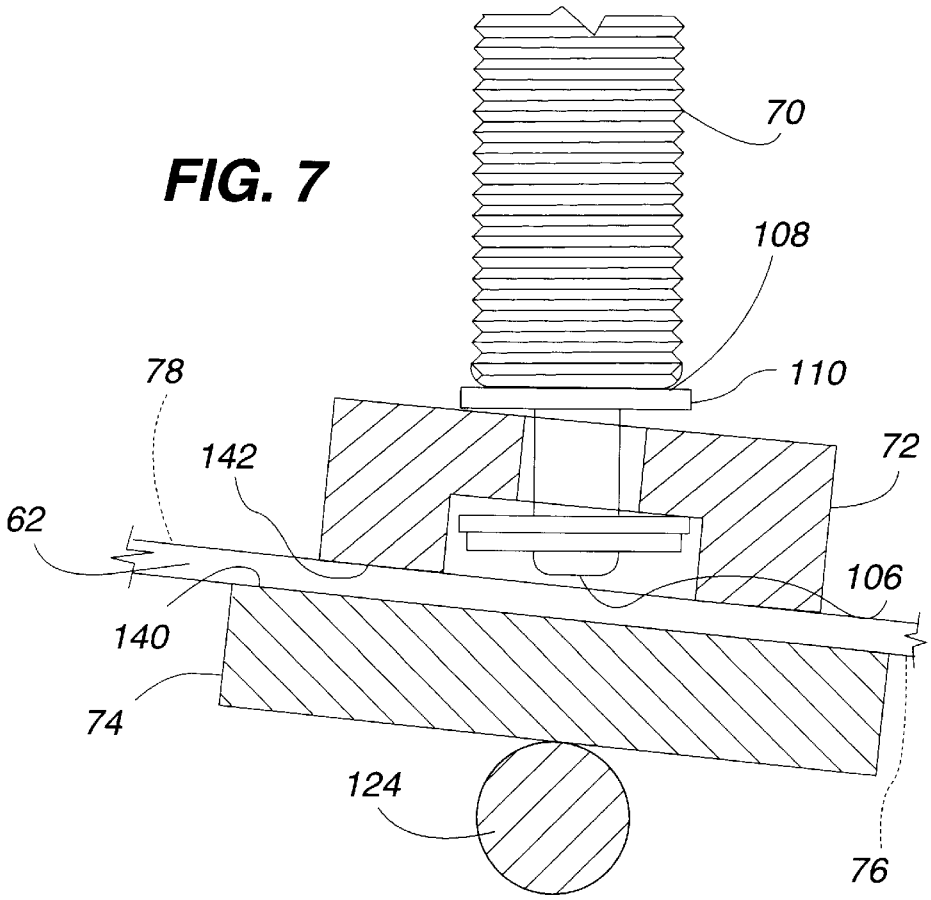
FIG. 7 is an enlarged view similar to FIG. 6 illustrating a swivel/hinged deflection of the top and bottom pads as the pads clamp to a portion of a bucket blade which is shown in phantom, and further illustrating the parallel alignment of the bucket blade and the contact surfaces of the top and bottom pads.

Details of the connection of the upper mounting pad 72 to the bottom end of the threaded rod 70 are shown in FIGS. 5–7. The upper mounting pad 72 is preferably formed from a solid round steel piece having a central hole 100 of a first diameter and a counterbore 102 of a second greater diameter formed on the bottom of the pad 72. In a preferred embodiment, the upper pad 72 has an outer diameter of approximately three inches, while the central hole 100 has a diameter of approximately 0.75 inches and the counterbore 102 has a diameter of approximately 1.50 inches. Additionally, the pad 72 has a preferable thickness of approximately one inch, while the depth of the counterbore 102 is approximately one-half inch.

FIGS. 6 and 7 illustrate that the end of the threaded rod 70 opposite the handle 98 includes a non-threaded extension 106 having a diameter smaller than that of the threaded rod 70. A shoulder 108 separates the bottom of the threaded rod 70 and the top of the extension 106. The diameter of the extension 106 is sufficiently small to allow the extension 106 to be inserted through the hole 100 of the upper pad 72 as shown in FIGS. 6 and 7. However, prior to inserting the extension 106 through the hole 100, a washer 110 is first inserted over the extension 106 so that the washer 110 is positioned between the shoulder 108 and a top surface of the upper pad 72. Once the washer 110 and the pad 72 have been inserted over the extension 106, a second washer 112 is preferably inserted over the extension 106 so that the washer 112 contacts the upper surface of the counterbore 102 as shown in FIG. 6. Finally, a third washer 114 is extended over the end of the extension 106 and is tack welded to the extension 106 at a point 116 to prevent the pad 72 and the washers 110, 112 and 114 from being removed from the extension 106 of the threaded rod 70. While the washer 114 is preferably connected at the end of the extension 106, additional means for substantially retaining the pad 72 and the washers 110 and 112 in their proper position may be used in place of the washer 114.

The washer 114 is welded to the extension 106 at the predetermined position 116 so that a space 120 (FIG. 6) remains between the top of the washer 110 and the shoulder 108 when the pad 72 and the washers 110 and 112 are supported by the welded washer 114 under the force of gravity as shown in FIG. 6. This space 120 provides the pad 72 and the washers 110 and 112 a certain amount of freedom to move or swivel about the extension 106. Thus, because the pad 72 and the washers 110 and 112 are not fixed to each other or to the extension 106, the pad 72 is free to move about the extension 106 and the washer 110 is free to rise up through the space 120 until it contacts the shoulder 108 (as shown for example in FIG. 7). The space 120 shown in FIG. 6 is preferably equal to the thickness of the washer 110. The significance of this swivel capability of the upper pad 72 will be described in greater detail below.

As described above, the lower mounting segment 68 includes the lower mounting pad 74 which is positioned at the rear end of the bar 53 as shown in FIGS. 2 and 5. The lower mounting pad 74 is preferably welded to a rod 124 which, in turn, is rotatably supported between holes formed in opposing bearings 126 which are welded to the sides of the bar 53 as shown in FIGS. 2–5. Connected in this manner, the lower pad 74 is capable of hinging about the rotational axis of the rod 124. The significance of this hinging capability will be described below.

The lower mounting segment 68 also includes a reinforcing steel plate 130 fixed to the flat surface 54 of the bar 53 just to the rear of the vertical tube 80. The reinforcing plate 130 serves to protect the top surface 54 of the steel bar 53 and further enhances the strength of the fork 50 by reinforcing a natural stress point (i.e., adding thickness to the steel bar 53) adjacent the point where the tube 80 is welded to the steel bar 53. The location of the reinforcing plate 130 is a natural stress point because it represents the farthest point from the lower pad 74 on the bar 53 prior to reaching the vertical tube 80 (i.e., the point where the bending force applied to the bar 53 reaches its highest level as the blade 62 lifts the fork 50).

To protect the side plates 90 and enhance contact at a specific point with an upper surface of the cutting edge 136, a contact rod 132 is preferably welded between the opposing side plates 90 as shown in FIGS. 4 and 5. The rod 132 is positioned so that a portion of the rod extends below the plates 90 to contact the upper surface of the blade cutting edge 136 as shown in FIG. 5. In this manner, the cutting edge 136 of the blade 62 comes into contact with the rod 132 as the blade 62 is inserted between the upper and lower mounting segments 66 and 68, respectively. The rounded bearing surface of the rod 132 ensures a consistent contact with the upper surface of the blade cutting edge 136, regardless of the shape or angle of the blade 62 with respect to the fork 50.

Because the cutting edge 136 of the blade 62 is typically thicker than the remainder of the blade 62 (to withstand the rigors of digging when the loader is not being used as a fork lift), the distance between the rod 132 and the reinforcing plate 130 is typically much larger than the distance between the upper and lower pads 72 and 74, respectively, when the pads are clamped to the upper and lower surfaces 78 and 76 of the blade 62 as shown in FIG. 5. In other words, the thickness of the blade 62 at the point where the pads 72 and 74 contact the blade is typically much less than the thickness of the cutting edge 136 of the blade 62. Additionally, the thickness of the blade 62 at the location of the pads 72 and 74 may vary depending on the precise location on the blade 62 where the pads 72 and 74 are clamped. For instance, reinforcing plates (not shown) may be fixed to the blade 62 at the clamping locations. It is primarily for these reasons that the pads 72 and 74 are provided with their respective swivel/hinge capabilities as described above.

Figure 8:
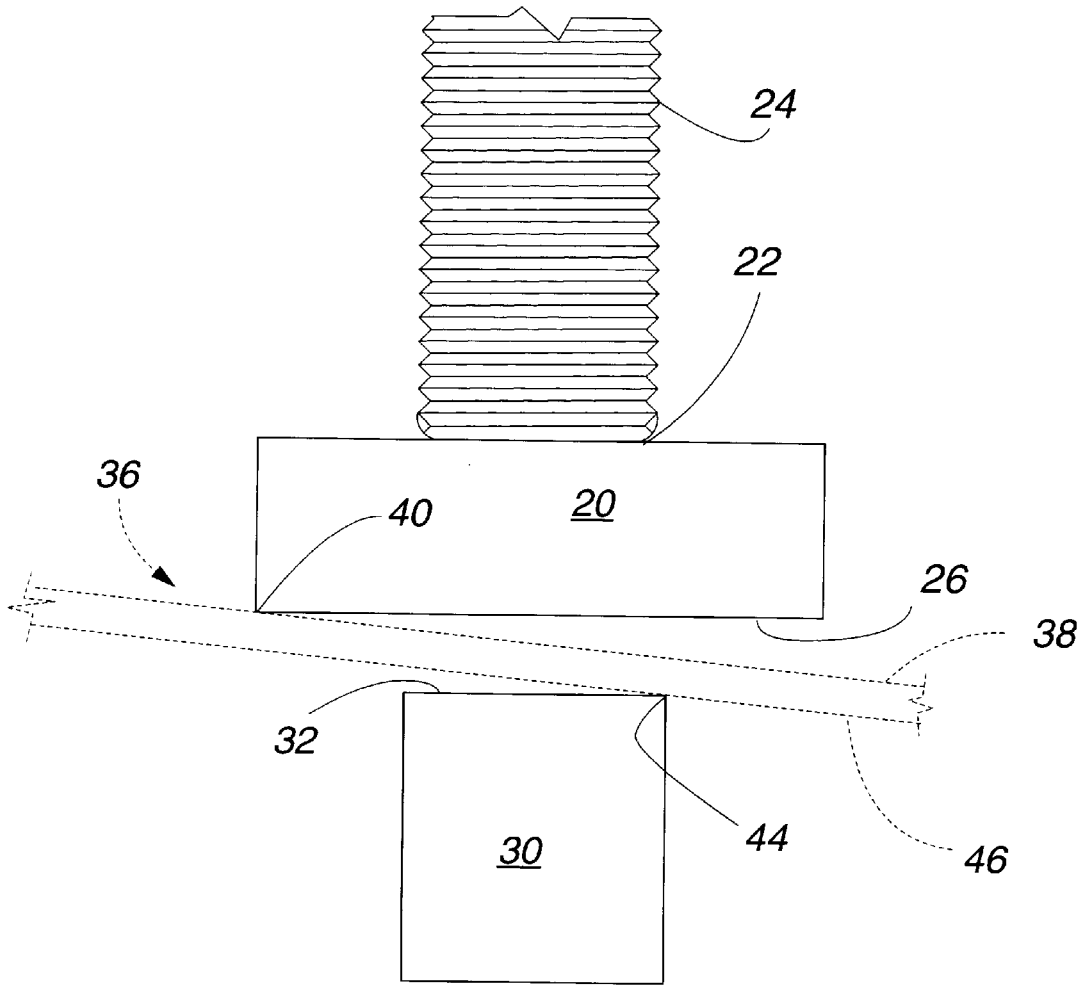
FIG. 8 PRIOR ART
FIG. 8 is a view of a prior art fork lift attachment which illustrates the contact between top and bottom contact surfaces and a portion of a bucket blade which is shown in phantom.

FIGS. 7 and 8 illustrate how a blade 62 of a loader bucket 52 may be inserted between the upper and lower mounting segments 66 and 68 of the fork 50 at an angle. Thus, while the relatively thick cutting edge 136 of the blade (not shown in FIGS. 7 and 8) may be positioned between the reinforcing plate 130 and the rod 132 in a substantially horizontal orientation (see FIG. 5), the upper and lower surfaces 78 and 76, respectively, of the bucket blade are likely to remain at an angle between the top and bottom pads 72 and 74. However, as described above, the bottom pad 74 can hinge freely on the rod 124 once the blade 62 is released to rest on the pad 74. In this manner, a contact surface 140 on the top of the lower pad 74 makes flush contact with the lower surface 76 of the blade 62, as shown in FIG. 7.

Once the blade 62 is properly positioned on the lower pad 74, the top pad 72 is lowered on the threaded rod 70 (by rotation of the handle 98) toward the upper surface 78 of the blade 62. As a first portion of the pad 72 comes into contact with the upper surface 78, the pad 72 will swivel about the extension 106 in the above-described manner until the entirety of a contact surface 142 on the bottom of the pad 72 is flush against the upper surface 78. Once flush contact has been achieved by both pads 72 and 74, the handle 98 may be turned further to tighten the grip of the pads 72 and 74 on the blade 62 and rigidly connect the fork 50 to the bucket 52.

The flush contact of the pads 72 and 74 against the blade 62, and the relatively large surface area of the pads themselves, represent major improvements over prior art fork mounting means. For instance, FIG. 8 represents the typical prior art means for fixing a fork to the blade 36 of a bucket. As previously described, the prior art upper pad 20 does not include the swivel capability of the top pad 72 of the present invention, nor does the lower bearing bar 30 include either the relatively large contact surface or the hinge capability of the lower pad 74. Thus, the upper and lower surfaces 38 and 46, respectively, of the blade 36 (FIG. 8) contact the prior art pad 20 and rod 30 only at specific points or edges 40 and 44. These limited contact points can generate and apply large, concentrated and unaligned forces on the metal of the blade 36 which can warp, perforate or otherwise damage the blade. Such problems are entirely avoided by the mounting attachment 60 and the pads 72 and 74 of the present invention due to the ability to use the entire surface areas of the pads to contact the respective surfaces of the blade 62 in a flush manner. Thus, the pads of the present invention can safely apply much larger forces to the bucket blade 62, thereby allowing the forks 50 be clamped tighter and support heavier loads than prior art forks without warping, perforating or otherwise damaging the blade.

While two specific types of swivel/hinge attachments have been described for the upper and lower pads 72 and 74, respectively, it is to be understood that the present invention is not limited by the exact form of these preferred swivel attachments and that other types of swivel/hinge mounts which ensure flush contact between the pads and the bucket blade are encompassed by the present invention. For example, while the preferred embodiment of the present invention utilizes a fixed nut 96 as shown in FIGS. 2–5, an alternative embodiment of the present invention (not shown) may employ a swivel connection between the nut 96 and the side plates 90 while maintaining a rigid or swivel connection between the end of the threaded rod 70 and the top pad 72. In this manner, the top pad 72 would still include a hinge capability for making flush contact with the top surface 78 of the blade 62, although the hinge capability would be due to the hinge connection of the nut 96 (and thus the rod 70) rather than the preferred swivel attachment between the rod 70 and the top pad 72.

Additionally, while the mounting attachment 60 of the present invention is shown in the preferred embodiment for mounting a fork to the bucket blade 62, it is to be understood that the mounting attachment 60 may also be used to attach other apparatus, such as a snow removal blade (not shown), to the loader bucket 52. Thus, the mounting attachment 60 may be beneficially used with any apparatus that is to be mounted to the blade 62 of a loader bucket, and the present invention is not limited to use of the mounting attachment 60 with clamp-on forks.

A presently preferred embodiment of the present invention has been described above with a degree of specificity. It should be understood, however, that this degree of specificity is directed toward the preferred embodiment. The invention itself is defined by the scope of the appended claims.

The invention claimed is:

1. An improved fork lift attachment for use with a loader bucket comprising a bar having a forward-facing tine and a rearward-facing mounting attachment, said mounting attachment including a cantilever support having a vertically movable rod, a top pad and a bottom pad, said vertically movable rod having a lower end attached to the top pad, the top pad contacting a top surface of a blade of the bucket, and the bottom pad attached to a rear end of the bar for contacting a bottom surface of the bucket blade, wherein the improvement comprises:

a hinge support for the bottom pad; and a reinforcement plate attached to the bar at a position forward of the bottom pad; and wherein:

the bottom pad is fixed to the hinge support to allow a contact surface of the bottom pad to hinge into flush contact with the bottom surface of the bucket blade;

the hinge support includes a rod rotatably attached to the rear end of the bar; and the bottom pad is fixedly attached to the rod.

2. An improved fork lift attachment for use with a loader bucket comprising a bar having a forward-facing tine and a rearward-facing mounting attachment, said mounting attachment including a cantilever support having a vertically movable rod, a top pad and a bottom pad, said vertically movable rod having a lower end attached to the top pad, the top pad contacting a top surface of a blade of the bucket, and the bottom pad attached to a rear end of the bar for contacting a bottom surface of the bucket blade, wherein the improvement comprises:

a hinge support for the bottom pad, the bottom pad being fixed to the hinge support to allow a contact surface of the bottom pad to hinge into flush contact with the bottom surface of the bucket blade; and a swivel attachment between the lower end of the vertically movable rod and the top pad to allow a contact surface of the top pad to swivel into flush contact with the top surface of the bucket blade.

3. An improved fork lift attachment as defined in claim 2, wherein:

the swivel attachment includes an extension extending below the vertically movable rod, said extension having a diameter smaller than a diameter of the vertically movable rod;

the extension extends through a hole formed in the top pad; and the swivel attachment further includes a stop member fixedly attached to the end of the extension to secure the top pad between the vertically movable rod and the stop member while allowing the top pad to swivel about the extension.

4. An improved fork lift attachment as defined in claim 3, wherein:

the swivel attachment further includes a first washer positioned between the top pad and the vertically movable rod.

5. An improved fork lift attachment as defined in claim 4, wherein:

the contact surface of the top pad includes a counter-bore; and the swivel attachment further includes a second washer positioned within the counter-bore between the top pad and the stop member.

6. An improved fork lift attachment as defined in claim 5, wherein:

the stop member comprises a third washer welded to the end of the extension.

7. An improved fork lift attachment as defined in claim 2, wherein the improvement further comprises:

a reinforcement plate attached to the bar at a position forward of the bottom pad.

8. An improved fork lift attachment for use with a loader bucket comprising a bar having a forward-facing tine and a rearward-facing mounting attachment, said mounting attachment including a cantilever support having a vertically movable rod, a top pad and a bottom pad, said vertically movable rod having a lower end attached to the top pad, the top pad contacting a top surface of a blade of the bucket, and the bottom pad attached to a rear end of the bar for contacting a bottom surface of the bucket blade, wherein the improvement comprises:

a swivel attachment between the lower end of the vertically movable rod and the top pad, and wherein:

the swivel attachment allows a contact surface of the top pad to swivel into flush contact with the top surface of the bucket blade;

the swivel attachment includes an extension extending below the vertically movable rod, said extension having a diameter smaller than a diameter of the vertically movable rod;

the extension extends through a hole formed in the top pad;

the swivel attachment further includes a stop member fixedly attached to the end of the extension to secure the top pad between the vertically movable rod and the stop member while allowing the top pad to swivel about the extension;

the swivel attachment further includes a first washer positioned between the top pad and the vertically movable rod;

the contact surface of the top pad includes a counter-bore; and the swivel attachment further includes a second washer positioned within the counter-bore between the top pad and the stop member.

9. An improved fork lift attachment as defined in claim 8, wherein:

the stop member comprises a third washer welded to the end of the extension.

10. An improved fork lift attachment as defined in claim 8, wherein the improvement further comprises:

a rod rotatably attached to the rear end of the bar, and wherein:

the bottom pad is fixedly attached to the rod to allow a contact surface of the bottom pad to hinge into flush contact with the bottom surface of the bucket blade.

11. An improved fork lift attachment as defined in claim 10, wherein the improvement further comprises:

a reinforcement plate attached to the bar at a position forward of the bottom pad.

12. An improved fork lift attachment for use with a loader bucket, comprising a forward-facing tine and a rearward-facing mounting attachment connected to the tine, the mounting attachment including an upper support and a vertically separated lower support between which a blade of the bucket is positioned when the tine is attached to the bucket, and wherein the improvement comprises:

an upper contact pad which is connected by a swivel to the upper support to contact an upper surface of the bucket blade over substantially an entire contact area of the upper contact pad;

a lower contact pad which is connected by a hinge to the lower support to contact a bottom surface of the bucket blade over substantially an entire contact area of the lower contact pad; and a compression mechanism connected between at least one of the contact pads and the support to which the one contact pad is connected to compress the bucket blade between the contact pads and frictionally retain the tine to project forwardly from the bucket.

13. A mounting attachment for temporarily mounting auxiliary apparatus to a blade of a loader bucket, said mounting attachment comprising:

a bottom pad having an upper surface for contacting a bottom surface of the bucket blade;

a cantilever support engaging a vertical rod to allow vertical movement of the vertical rod;

a top pad having a lower surface for contacting a top surface of the bucket blade;

a swivel attachment connected between the vertical rod and the top pad, said swivel attachment enabling the lower surface of the top pad to swivel into flush contact with the top surface of the bucket blade; and a hinge support for the bottom pad, said hinge support enabling the upper surface of the bottom pad to hinge into flush contact with the bottom surface of the bucket blade.

14. A mounting attachment as defined in claim 13, wherein:

said auxiliary apparatus comprises a fork lift attachment.

15. An improved fork lift attachment as defined in claim 12 wherein:

the upper support comprises a cantilever support engaging a vertical rod to allow vertical movement of the vertical rod; and the upper contact pad swivel is connected to the vertical rod.

16. An improved fork lift attachment as defined in claim 15 wherein:

the upper contact pad swivel includes an extension extending below the vertically movable rod, said extension having a diameter smaller than a diameter of the vertically movable rod;

the extension extends through a hole formed in the upper contact pad; and the upper contact pad swivel further includes a stop member fixedly attached to the end of the extension to secure the upper contact pad between the vertically movable rod and the stop member while allowing the upper contact pad to swivel about the extension.

17. An improved fork lift attachment as defined in claim 16 wherein:

the upper contact pad swivel further includes a first washer positioned between the upper contact pad and the vertically movable rod.

18. An improved fork lift attachment as defined in claim 17 wherein:

a contact surface of the upper contact pad includes a counter-bore; and the upper contact pad swivel further includes a second washer positioned within the counter-bore between the upper contact pad and the stop member.

19. An improved fork lift attachment as defined in claim 18 wherein:

the stop member comprises a third washer welded to the end of the extension.

20. An improved fork lift attachment as defined in claim 12 wherein:

the lower contact pad hinge includes a rod rotatably attached to a rear portion of the lower support; and the lower contact pad is fixedly attached to the rod.

21. An improved fork lift attachment as defined in claim 20 further comprising:

two bearings fixedly attached to opposite sides of the lower support to rotatably support the rod.

22. An improved fork lift attachment as defined in claim 12 further comprising:

a reinforcement plate attached to the bottom support at a position forward of the lower contact pad hinge.

* * * * *